US006577282B1

(12) United States Patent
Rao et al.

(10) Patent No.: US 6,577,282 B1
(45) Date of Patent: Jun. 10, 2003

(54) METHOD AND APPARATUS FOR ZOOMING AND RECONFIGURING CIRCULAR BEAMS FOR SATELLITE COMMUNICATIONS

(75) Inventors: Sudhakar K. Rao, Torrance, CA (US); Chih-Chien Hsu, Torrance, CA (US); George Voulelikas, El Segun, CA (US); Stephen A. Robinson, North Hills, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/619,042

(22) Filed: Jul. 19, 2000

(51) Int. Cl.[7] ..... H01Q 13/00

(52) U.S. Cl. ..... 343/781 CA; 343/840; 343/781 P

(58) Field of Search ..... 343/781 CA, 781 P, 343/786, 772, 775, 840; H01Q 13/00

(56) References Cited

U.S. PATENT DOCUMENTS

| | | | | | |
|---|---|---|---|---|---|
| 4,042,933 | A | * | 8/1977 | Lapp | 343/761 |
| 4,504,835 | A | * | 3/1985 | Howard et al. | 343/755 |
| 4,559,540 | A | * | 12/1985 | Betsudan et al. | 343/761 |
| 4,562,441 | A | * | 12/1985 | Berette et al. | 343/781 P |
| 4,604,624 | A | * | 8/1986 | Amitay et al. | 343/361 |
| 4,668,955 | A | * | 5/1987 | Smoll | 343/761 |
| 5,459,475 | A | * | 10/1995 | Shen et al. | 343/781 P |
| 5,485,168 | A | * | 1/1996 | Parekh | 343/761 |
| 5,546,097 | A | * | 8/1996 | Ramanujam et al. | 343/781 R |
| 5,673,056 | A | * | 9/1997 | Ramanujam et al. | 343/756 |
| 5,859,619 | A | * | 1/1999 | Wu et al. | 343/781 CA |
| 6,031,502 | A | * | 2/2000 | Ramanujam et al. | 343/761 |
| 6,043,788 | A | * | 3/2000 | Seavey | 343/781 CA |
| 6,102,339 | A | * | 8/2000 | Wu et al. | 244/173 |
| 6,198,455 | B1 | * | 3/2001 | Luh | 343/781 CA |
| 6,225,964 | B1 | * | 5/2001 | Fermelia et al. | 343/909 |
| 6,243,047 | B1 | * | 6/2001 | Brown | 343/781 CA |
| 6,266,024 | B1 | * | 7/2001 | Ramanujam et al. | 343/781 CA |

FOREIGN PATENT DOCUMENTS

| | | | |
|---|---|---|---|
| EP | 0 420 739 A1 | 4/1991 | H01Q/25/00 |
| EP | 0 420 739 B1 | 9/1993 | H01Q/25/00 |
| EP | 1 014 483 A1 | 6/2000 | H01Q/3/12 |

OTHER PUBLICATIONS

A. Roederer and M. Sabbadini, "A Novel Semi–Active Multibeam Antenna Concept", IEEE Antennas and Propagation Symposiom Digest, 1990, pp. 1884–1887..

J.U.I Syed and A.D. Oliver, "Variable Beamwidth Dual Reflector Antenna", IEE Conference on Antennas and Propagation, Apr. 1995, Publication #407, pp. 92–96.

* cited by examiner

*Primary Examiner*—Don Wong
*Assistant Examiner*—Trinh Vo Dinh
(74) *Attorney, Agent, or Firm*—Gates & Cooper LLP

(57) ABSTRACT

A method and system for reconfiguring an antenna system are disclosed. The system comprises a feed horn, a subreflector, and a main reflector. The feed horn is pointed at an axis removed from the bisector axis of the subreflector. The distance between the feed horn and the subreflector can be changed to defocus the feed horn with respect to the subreflector, wherein a size of the outgoing beam emanating from the main reflector changes when the distance between the feed horn and the subreflector is changed. The method comprises pointing an axis of a feed horn at a subreflector, wherein the axis of the feed horn is aligned differently from the bisector axis of the subreflector, and changing the distance between the feed horn and the subreflector to defocus the feed horn with respect to the subreflector, wherein a size of an outgoing beam emanating from a main reflector changes when the distance between the feed horn and the subreflector is changed.

21 Claims, 13 Drawing Sheets

| Feed Defocus | | Reflector Gimbaling | Beamwidth | | Peak Gain | EOC |
|---|---|---|---|---|---|---|
| | Az | El | Az | El | | |
| inches | degrees | degrees | degrees | degrees | dBi | dBi |
| 0.0 | 4.48 | 3.68 | 1.9 | 2.0 | 35.1 | 33.2 |
| 10.0 | 4.38 | 3.22 | 3.2 | 3.2 | 33.5 | 30.5 |
| 15.0 | 4.25 | 3.25 | 4.5 | 4.6 | 31.2 | 28.2 |
| 18.5 | 4.15 | 3.60 | 6.2 | 6.1 | 29.0 | 26.0 |
| 20.5 | 4.10 | 3.88 | 7.1 | 7.3 | 27.2 | 24.2 |
| 23.0 | 4.00 | 4.20 | 9.5 | 8.9 | 22.7 | 19.5 |

| Feed Defocus | Reflector Gimbaling | | Beamwidth | | Peak Gain | EOC |
|---|---|---|---|---|---|---|
| | Az | El | Az | El | | |
| inches | degrees | degrees | degrees | degrees | dBi | dBi |
| 0.0 | 0.00 | −0.10 | 2.0 | 2.0 | 35.7 | 33.6 |
| 10.0 | −0.02 | −0.52 | 2.9 | 3.1 | 34.0 | 31.0 |
| 15.0 | −0.04 | −0.42 | 4.1 | 4.7 | 31.6 | 28.6 |
| 18.5 | −0.05 | −0.06 | 5.6 | 5.7 | 29.6 | 26.6 |
| 21.0 | −0.08 | 0.30 | 6.9 | 7.2 | 27.0 | 24.0 |
| 23.0 | −0.12 | 0.60 | 9.2 | 8.9 | 23.8 | 20.2 |

TABLE 1

| Feed Defocus | | Reflector Gimbaling | Beamwidth | | Peak Gain | EOC |
|---|---|---|---|---|---|---|
| | Az | El | Az | El | | |
| inches | degrees | degrees | degrees | degrees | dBi | dBi |
| 0.0 | 4.48 | 3.68 | 1.9 | 2.0 | 35.1 | 33.2 |
| 10.0 | 4.38 | 3.22 | 3.2 | 3.2 | 33.5 | 30.5 |
| 15.0 | 4.25 | 3.25 | 4.5 | 4.6 | 31.2 | 28.2 |
| 18.5 | 4.15 | 3.60 | 6.2 | 6.1 | 29.0 | 26.0 |
| 20.5 | 4.10 | 3.88 | 7.1 | 7.3 | 27.2 | 24.2 |
| 23.0 | 4.00 | 4.20 | 9.5 | 8.9 | 22.7 | 19.5 |

TABLE 2

BOTH AXES ARE IN DEG.

Stowed Antenna

METHOD AND APPARATUS FOR ZOOMING AND RECONFIGURING CIRCULAR BEAMS FOR SATELLITE COMMUNICATIONS

BACKGROUND OF THE INVENTION

1. Field of the Invention.

This invention relates in general to communications systems, and in particular to a method and apparatus for zooming and reconfiguring circular beams for satellite communications.

2. Description of Related Art.

Communications satellites have become commonplace for use in many types of communications services, e.g., data transfer, voice communications, television spot beam coverage, and other data transfer applications. As such, satellites must provide signals to various geographic locations on the Earth's surface. As such, typical satellites use customized antenna designs to provide signal coverage for a particular country or geographic area.

However, satellites typically are designed to provide a fixed satellite beam coverage for a given signal. For example, Continental United States (CONUS) beams are designed to provide communications services to the entire continental United States. Once the satellite transmission system is designed and launched, changing the beam patterns, and/or moving the beam coverage to different geographical locations, is difficult.

The need to change the beam pattern provided by the satellite has become more desirable with the advent of direct broadcast satellites that provide communications services to specific areas. As areas increase in population, or additional subscribers in a given area subscribe to the satellite communications services, e.g., DirecTV, satellite television stations, etc., the satellite must divert resources to deliver the services to the new subscribers. Without the ability to change beam patterns and coverage areas, additional satellites must be launched to provide the services to possible future subscribers, which increases the cost of delivering the services to existing customers.

Some present systems are designed with minimal flexibility in the delivery of communications services. For example, a semi-active multibeam antenna concept has been described for mobile satellite antennas. The beams are reconfigured using a Butler matrix and a semi-active beamformer network (BFN) where a limited number (3 or 7) feed elements are used for each beam and the beam is reconfigured by adjusting the phases through an active BFN. This scheme provides limited reconfigurability over a narrow bandwidth and employs complicated and expensive hardware.

Another minimally flexible system uses a symmetrical Cassegrain antenna that uses a movable feed horn, which defocuses the feed and zooms circular beams over a limited beam aspect ratio of 1:2.5. This scheme has high sidelobe gain and low beam-efficiency due to blockage by the feed horn and the subreflector of the Cassegrain system. Further, this type of system splits or bifurcates the main beam for beam aspect ratios greater than 2.5, resulting in low beam efficiency values.

It can be seen, then, that there is a need in the art for a communications system that can be reconfigured in-flight to accommodate the changing needs of uplink and downlink traffic. It can also be seen that there is a need in the art for a communications system that can be reconfigured in-flight without the need for complex systems. It can also be seen that there is a need in the art for a communications system that can be reconfigured in-flight that has high beam-efficiencies and high beam aspect ratios.

SUMMARY OF THE INVENTION

To overcome the limitations in the prior art described above, and to overcome other limitations that will become apparent upon reading and understanding the present specification, the present invention discloses a method and system for reconfiguring an antenna system The system comprises a feed horn, a subreflector, a main reflector, and a connecting structure. The feed horn is pointed at an axis removed from the bisector axis of the subreflector. The distance between the feed horn and the subreflector can be changed using the connecting structure to defocus the feed horn with respect to the subreflector, wherein a size of the outgoing beam emanating from the main reflector changes when the distance between the feed horn and the subreflector is changed.

The method comprises selecting a geometry and a feed horn size for a desired zoomable range of an outgoing antenna beam, pointing an axis of a feed horn at a subreflector, wherein the axis of the feed horn is aligned differently from the bisector axis of the subreflector, selectively changing the distance between the feed horn and the subreflector to defocus the feed horn with respect to the subreflector, wherein a size of the outgoing beam emanating from a main reflector changes when the distance between the feed horn and the subreflector is changed, and selecting an angle for a reflector gimbal mechanism based on a desired geographic location of the outgoing beam and a desired size of the outgoing bear The present invention provides a communications system that can be reconfigured in-flight to accommodate the changing needs of uplink and downlink traffic. The present invention also provides a communications system that can be reconfigured in-flight without the need for complex systems. The present invention also provides a communications system that can be reconfigured in-flight and has high beam-efficiencies and high beam aspect ratios.

BRIEF DESCRIPTION OF THE DRAWINGS

Referring now to the drawings in which like reference numbers represent corresponding parts throughout.

Tables 1–2 summarize the typical performance of the antenna system.

DETAILED DESCRIPTION OF THEE PREFERRED EMBODIMENT

Figure 1:
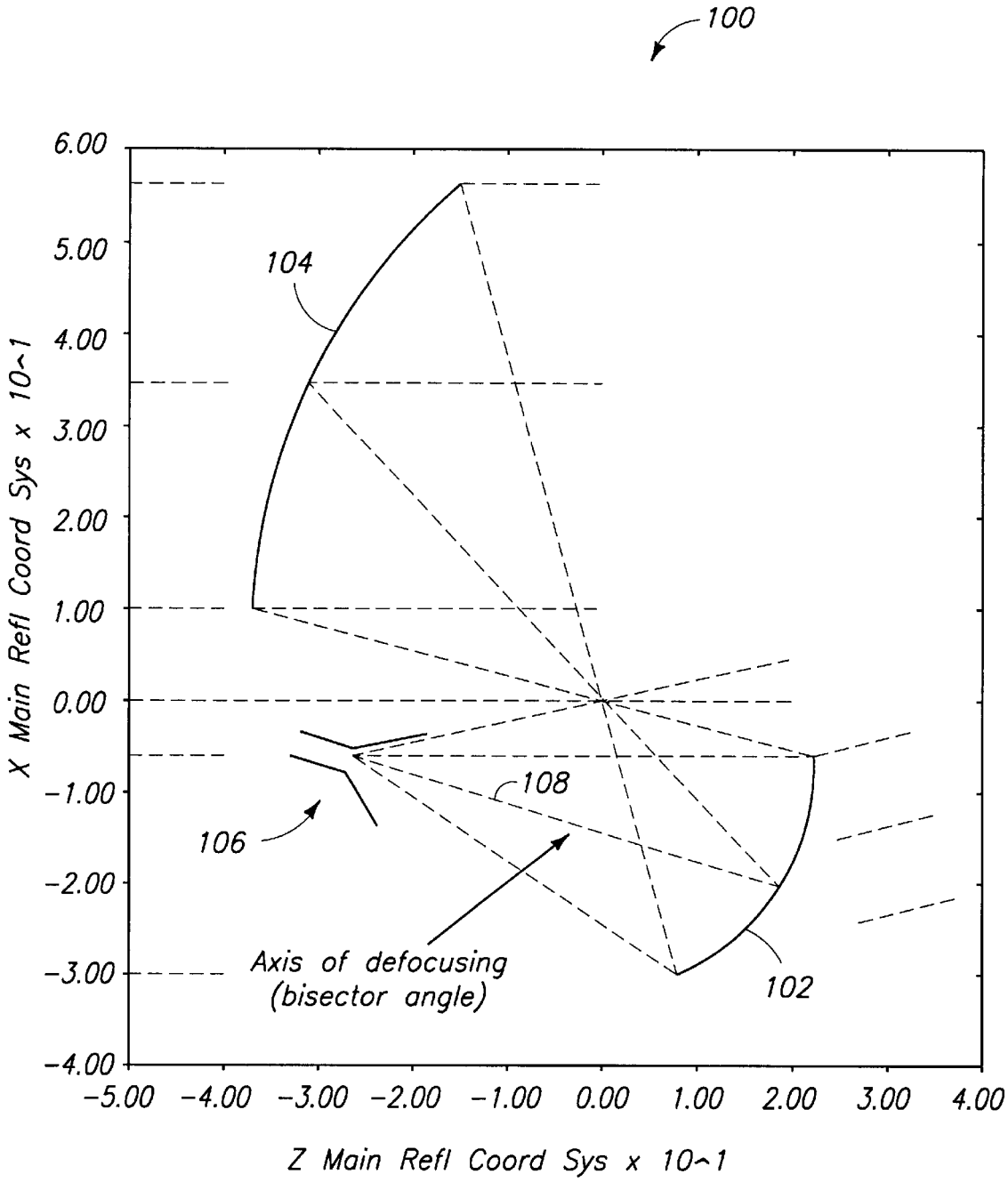
FIG. 1 illustrates the typical geometry of the Gregorian antenna configuration of the present invention.

In the following description of the preferred embodiment, reference is made to the accompanying drawings which form a part hereof, and in which is shown byway of illustration a specific embodiment in which the invention may be practiced. It is to be understood that other embodiments maybe utilized and structural changes may be made without departing from the scope of the present invention.

Overview of the Related Art

Related existing satellite designs typically have fixed beam shapes and therefore cannot be adapted to changing requirements after the satellite is launched. There are many commercial as well as military applications where either the beam size or the beam location on the surface of the Earth, or both, need to be reconfigured based on the traffic demands, changes in the business plan, or required changes in the coverage scenario. Further, satellite systems require global coverage using multiple circular beams with frequency reuse where each beam can be independently located anywhere over the global field-of-view, and the circular beam sizes are modifiable over a large aspect ratio, e.g., maximum beam diameter to minimum beam diameter ratio. Current methods of beam reconfigurability are either limited to a small aspect ratio of about 1:2.5, or involve the use of phased arrays which are much more complicated and expensive, and require increased power capabilities on board the satellite.

Overview of the Present Invention

The present invention provides a simple and an efficient method for zooming an antenna beam and reconfiguring the beam over the global field-of-view for communication satellites. The present invention is capable of changing the circular beam size over an aspect ratio of 1:5 and reconfiguring the beam over a +/−9.0 degrees global field-of-view from a geo-stationary, typically geosynchronous, satellite.

The present invention uses a dual-reflector antenna system of Gregorian geometry with a movable feed that is focused and defocused along an 'optimal axis' to zoom the beam, and uses main reflector gimballing to reconfigure the beam location. The feed horn focusing/defocusing is accomplished by moving the feed horn, or by moving the structure which connects the subreflector and the main reflector. The feed size and the axis of feed defocusing are optimized such that the beam is zoomed over a wide aspect ratio of about 1:5 without significantly deteriorating the beam performance. Lower antenna losses and lower cross-polarization levels can be achieved over the zoomable range compared to other methods. Various methods of mechanical implementation of the present invention are disclosed.

Multiple antennas implementing the present invention can be used on each satellite to generate multiple beams where each beam can be reconfigured independently over the global field-of-view. The present invention provides the capability of providing a beam zooming function over a large beam aspect ratio which is twice as large as current methods, e.g., 1:5 compared to 1:2.5. Further, the present invention provides moderate beam efficiency values over the complete zooming range of the beams, provides extremely low cross-polar levels dower than −30 dB relative to copolar peak), achieves minimal scan loss by using main reflector gimballing to scan the beams, allows for multiple antennas to be used on a single satellite with independent control of each beam, and provides a simple, light-weight, power-efficient, and inexpensive antenna configuration.

The antenna configuration disclosed herein employs a dual-reflector antenna system with a parabolic main reflector and an ellipsoidal subreflector. Both the reflectors operate in the offset configuration to avoid beam blockage. The subreflector axis is tilted relative to the main reflector axis, which satisfies the Mitzuguchi condition, to reduce the cross-polar radiation. The present invention uses an optimal feed size in conjunction with an "optimal axis" for feed defocussing, which results in large zoomable range of circular beams with an aspect ratio of about 1:5. The beam location reconfigurability over the global field-of-view is achieved by gimballing the main reflector over a +/−5 degree range using reflector pointing mechanisms (RPMs). The present invention also significantly reduces the scan loss for reconfigured beams. The present invention can be used for simultaneous transmission and reception of RF signals by diplexing the feed horn. The invention can also be extended to shaped beams by shaping the subreflector and the main reflector accordingly.

Configuration

FIG. 1 illustrates the typical geometry of the Gregorian antenna configuration of the present invention.

The antenna system 100 is a dual reflector design utilizing a subreflector 102 and a main reflector 104 comprising two reflective surfaces. The surface of subreflector 102 can reflect incoming signals of all polarizations. The feed horn 106 emits a radio frequency (RF) signal aimed at the subreflector 102 typically along the bisector angle 108.

Dual reflector systems typically utilize a main reflector 104 and a subreflector 102. Two common configurations of dual reflector antenna systems are known as "Gregorian" and "Cassegrain." Typically, the main reflector 104 is specifically shaped or parabolic and the subreflector 102 is ellipsoid in shape for a Gregorian configuration or hyperboloid in shape for a Cassegrain configuration, but may be specially shaped as well. In typical dual reflector systems neither the main reflector 104 nor the subreflector 102 are polarized and, therefore, the main reflector 104 and the subreflector 102 reflect all polarizations of incident signals from the feed horn 106.

Existing designs using antenna system 100 have limitations which are overcome using the present invention. First, related art systems 100 employ large feeds such that the illumination taper on the subreflector 102 is at least 15 dB when the feed is located at the focal point of the subreflector 102. This is to minimize the spillover loss. However, for zooming applications where the feed horn 106 is defocussed towards the subreflector 102, the distance between the feed horn 106 and the subreflector 102 falls in the near-field of the feed horn 106, e.g., the distance between the feed horn 106 and the subreflector 102 is less than 0.5 d*d/wavelength, where d is the feed horn 106 diameter. This near field condition causes more uniform illumination on the subreflector 102 and restricts the maximum size of the beam This restriction on the beam size limits the zoomable range of the antenna system 100.

Secondly, related art designs employ a feed horn 106 axis, i.e., the direction in which the feed horn 106 is pointed and moved (defocused) relative to the subreflector 102, as the angular bisector 108 of the subtended cone angle on the subreflector 102, as shown in FIG. 1. This axis 108 is optimum when the feed horn 106 is located at the focal point of subreflector 102, but is non-optimal for zoomed beams where the feed horn 106 is moved away from the focal point from the subreflector 102, thereby restricting the zoom range of the antenna system 100.

Figure 2:
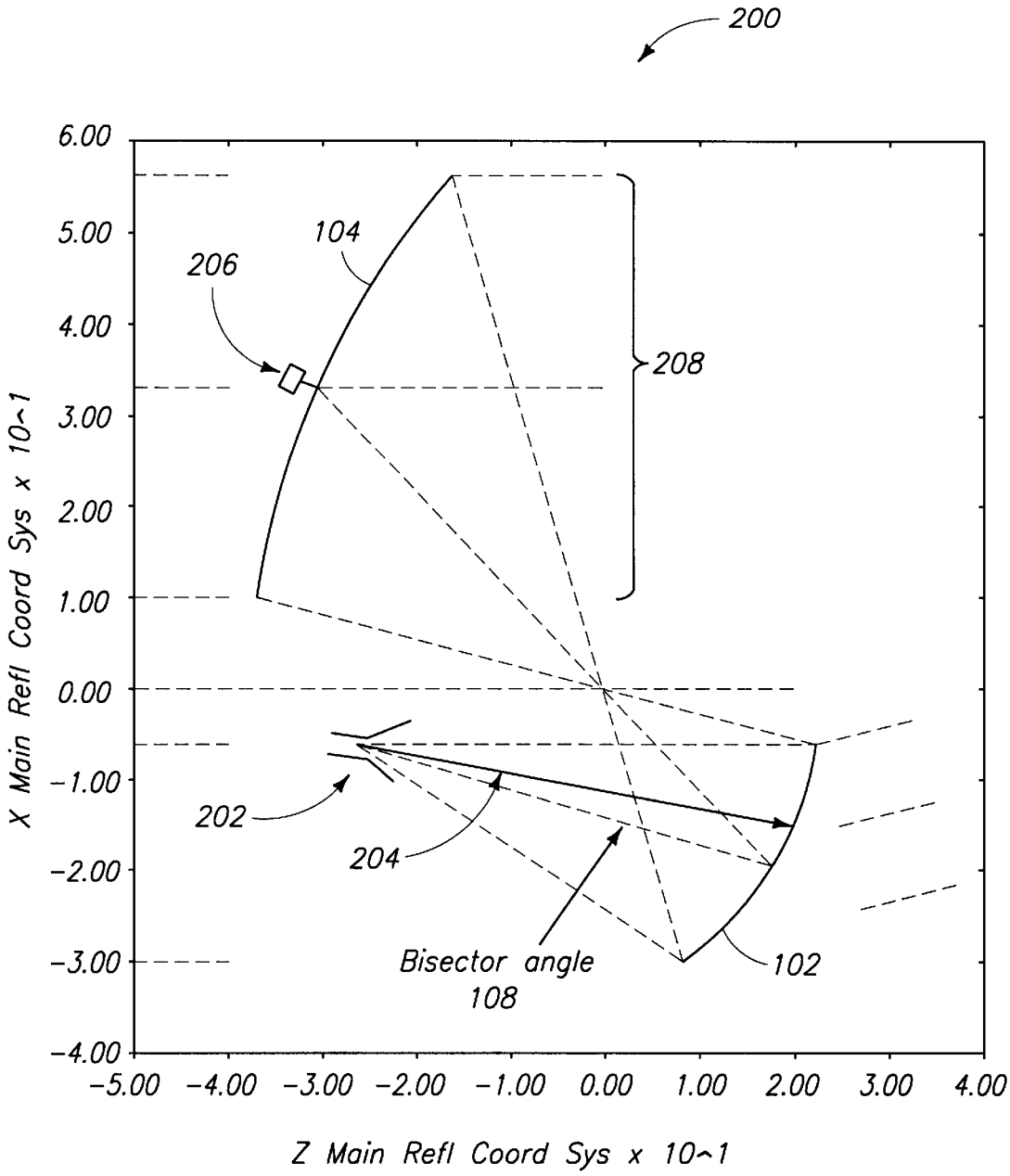
FIG. 2 illustrates the specific antenna configuration of the present invention.

FIG. 2 illustrates the antenna configuration of the present invention.

Antenna system 200 is similar to antenna system 100, comprising a subreflector 102, a main reflector 104, and a feed horn 202. Feed horn 202 is smaller than feed horn 106, that the illumination taper on the subreflector 102 when the feed horn 202 is at the focal point of subreflector 102 is approximately 8 dB. This reduced illumination taper compared to antenna systems 100 of the related art ensures that the distance between the feed horn 202 and subreflector 102 is outside of the near field, e.g., the distance is greater than 0.5 d*d/wavelength when the feed horn 202 is closest to the subreflector 102. This position is also known as being defocused to the extreme location. When the feed horn 202 is defocused at the extreme position, the illumination on the subreflector is tapered, which enables system 200 to achieve the maximum zoomable range of the beams. As such, the axis of the feed horn 202 needs to be shifted away from the bisector angle 108 of the subreflector 202 to achieve a larger zooming range of the feed horn 202. The system 200 therefore points the feed horn 202 along a different axis than the bisector axis 108, called the "optimal axis" 204 for feed horn 202 defocusing. This allows for a larger beam aspect ratio of 1:5 for zooming the feed horn 202 towards the subreflector 102 and away from the subreflector 102. The optimal axis 204 is typically tilted up relative to the bisector axis 108, which makes the feed horn 202 look closer to the center of the subreflector 102. The optimal axis 204 of the feed horn 202 defocusing enhances the zooming range of the feed horn 202. The optimal axis 204 can be offset in any direction from the bisector angle, depending on the desired beam patterns that will emanate from system 200.

Feed horn 202 is typically zoomed through the focal point of subreflector 202, but can also be displaced from the focal point in the transverse plane away from the focal point.

As the feed horn 202 moves with respect to the subreflector 102, e.g., the subreflector 102 moves closer/farther away from feed horn 202 or feed horn 202 moves closer/farther away from subreflector 102, the center of the beam 208 emanating from system 200 will move slightly. This moves the center of the beam 208 with respect to the location of the downlink beam 208 on the Earth's surface. In certain situations, this will be a desired result; however, in other situations, it is desired that the center of the downlink beam 208 should remain relatively stationary. In those situations, mechanism 206 can compensate for the movement of the center of the beam 208 from feed horn 202 by moving main reflector 104 to maintain relative stationary position of the beam 208 with respect to a particular location on the Earth's surface.

Further, beam 208 locations on the globe can be reconfigured using the main reflector 104 mechanism 206 without focusing or defocusing feed horn 202. Mechanism 206 is typically a gimballing mechanism that can move main reflector 104 in two directions, but can be other types of mechanisms that can move main reflector 104 in two or three directions if desired. The main reflector 104 movement reduces the beam 208 scan by a factor of two and as a result the scan loss for beams 208 located at the edge of the Earth's surface are reduced approximately by a factor of four.

Figure 3:
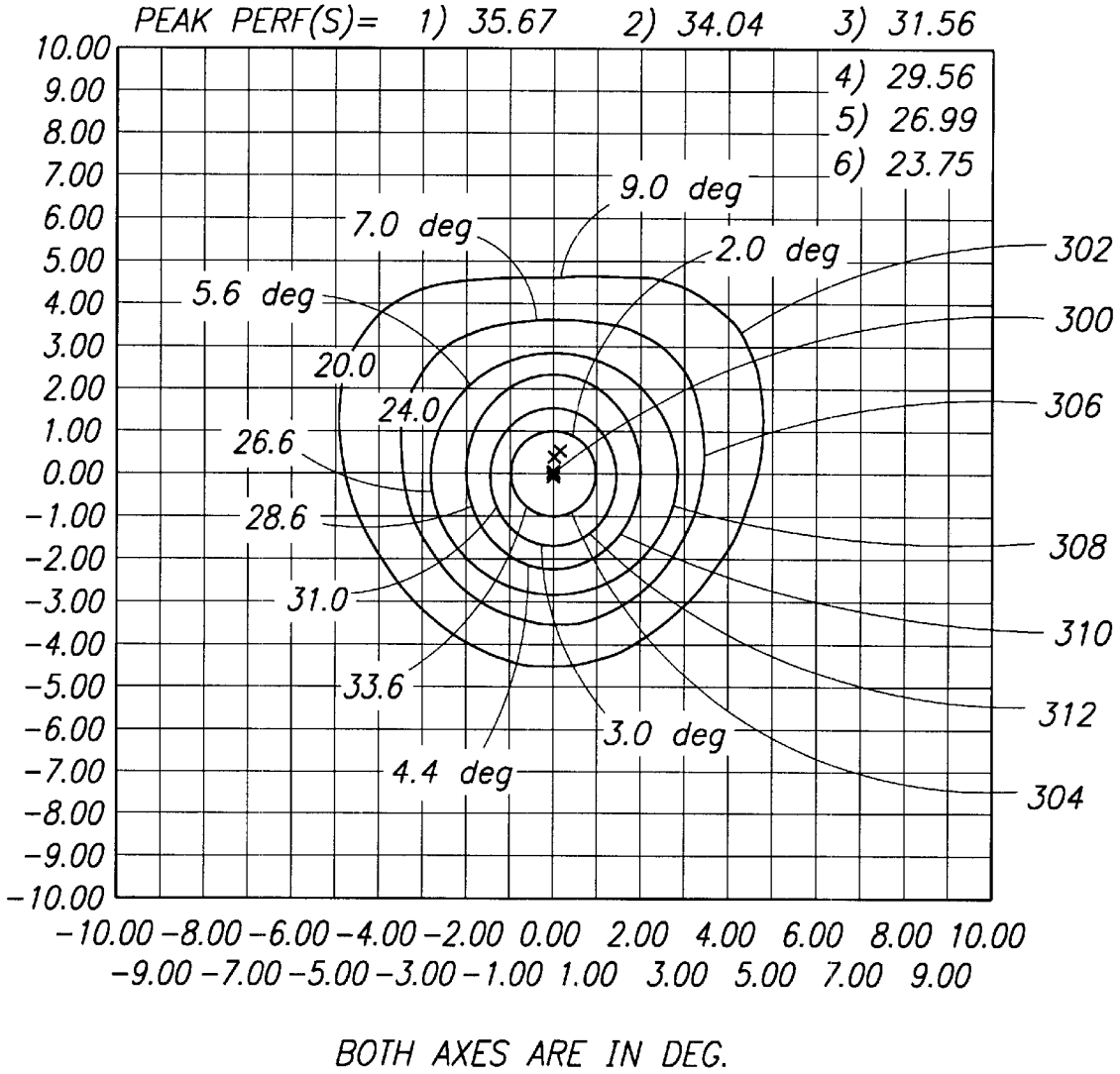
FIG. 3 illustrates the beam contours of a nominal 2.0 degree beam zoomed to different sizes (from 2.0 degrees to 9.0 degrees diameter) when the beams are located at the center of the Earth as viewed from the satellite.

FIG. 3 illustrates the beam contours of a nominal 2.0 degree beam zoomed to different sizes (from 2.0 degrees to 9.0 degrees diameter) when the beams are located at the center of the earth as viewed from the satellite.

Point 300 is the center of the Earth. As system 200 moves the feed horn 202 with respect to the subreflector 102, the size of beam 208 changes. For example, when feed horn 202 is at its closest point to subreflector 102, beam pattern 302 is created. Beam pattern 302 is a nine degree beam pattern. When the feed horn 202 is at its farthest point from subreflector 102, beam pattern 304 is created, which is a two degree beam pattern. Various beam patterns 306–312 are shown between the two degree beam pattern 304 and the nine degree pattern 302. The distance that feed horn 202 and/or subreflector 102 must move to traverse from the two degree pattern 304 and the nine degree pattern 302 is approximately 23 inches. As discussed above, the centers of each beam pattern 302–312 move with respect to each other, which can be compensated for by using mechanism 206 to move main reflector 104.

Figure 4:
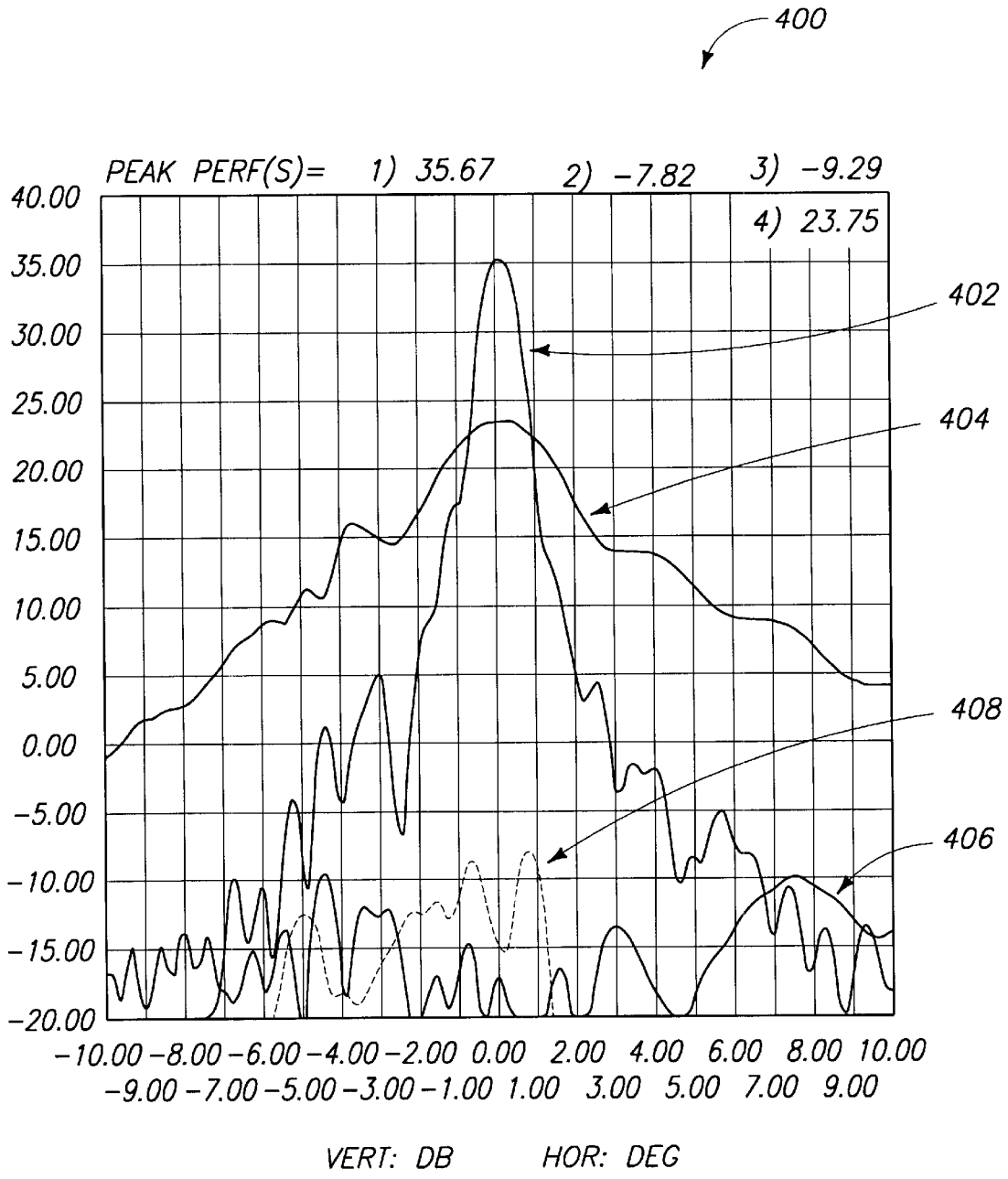
FIG. 4 illustrates the azimuth cuts of the two degree beam and the nine degree beam of FIG. 3.

FIG. 4 illustrates the azimuth cuts of the two degree beam and the nine degree beam of FIG. 3.

Graph 400 shows co-polar radiation patterns 402 and 404, and cross-polar radiation patterns 406 and 408. Patterns 402 and 406 correspond to the two-degree beam 304, and patterns 404 and 408 correspond to the nine-degree beam 302. Cross-polar patterns 406 and 408 are considerably lower in power than the corresponding co-polar pattern 402 and 404 peaks, and are in the range of 30 dB below the co-polar pattern 402 and 404 peaks. Table 1 summarizes the typical performance of the antenna system 200 of the present invention when the beams are pointed towards the center of the Earth.

Repositioning Of The Downlink Beam Using Defocusing and Gimbal Mechanism

Figure 5:
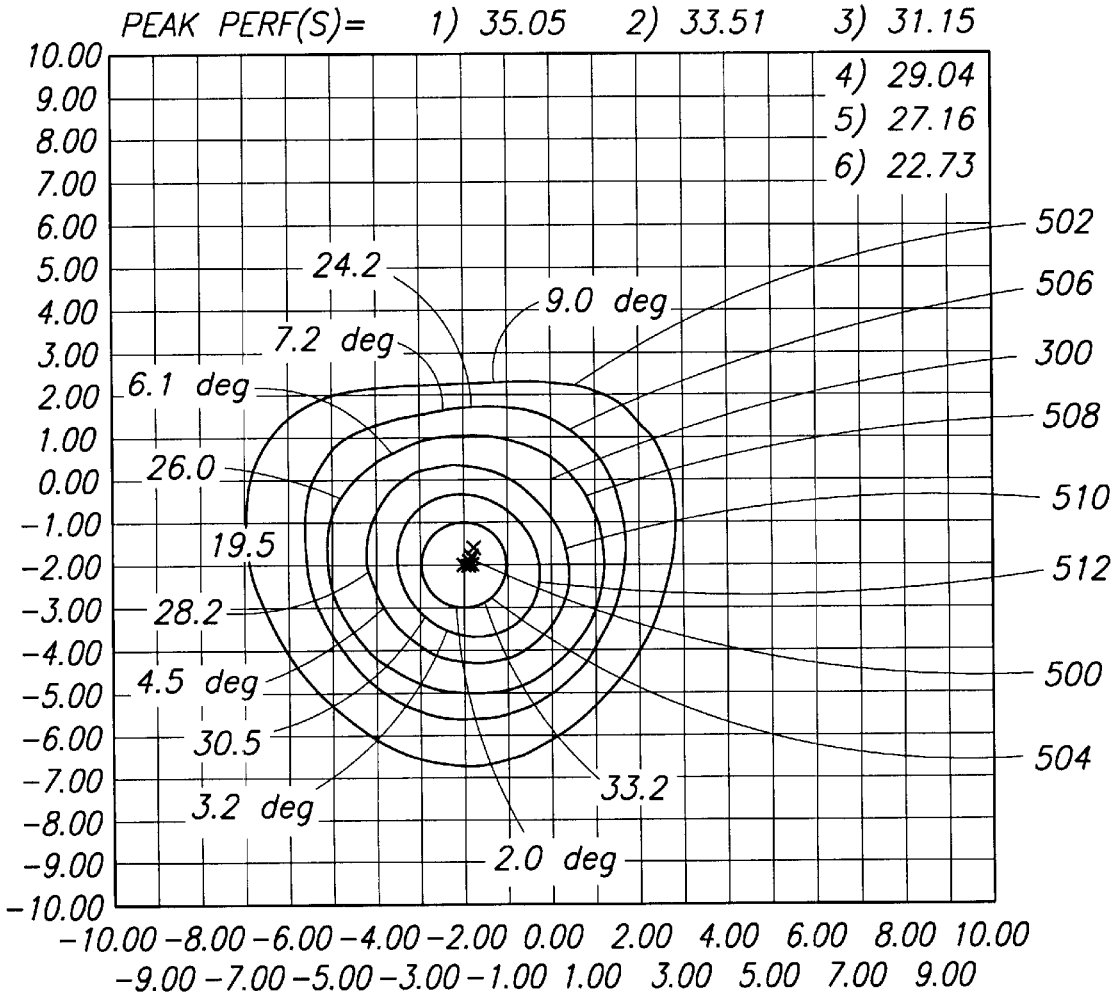
FIG. 5 illustrates contours of the beam generated by the present invention when the beams are reconfigured to point away from the center of the Earth.

FIG. 5 illustrates contours of the beam generated by the present invention when the beams are reconfigured to point away from the center of the Earth.

The beam 208 can be reconfigured to point at the edge of the Earth by using mechanism 206 to move the main reflector 104. As such, instead of being pointed at point 300, the beam 208 is directed at point 500, which is several degrees away from the center of the Earth. As such, the signal strength and/or coverage of the beam 208 can be changed on orbit by a large magnitude. Different areas can now be provided signals, or additional areas on the Earth's surface can now be provided communications links, without the need for repositioning the satellite or launching additional satellites to provide signal coverage.

Contours 502–512 of the beam 208 over the 2.0 degree to 9.0 degree zooming range, which correspond to contours 302–312 respectively, are shown in FIG. 5. As before, the feed horn 202 when defocused for a 9.0 degree beam is 23 inches, and provides contours 502–512 that are substantially identical to the nominal beam contours 302–312 respectively, i.e., the beam contours 302–312 generated when the beam 208 is directed towards the center of the Earth, shown in FIG. 3.

Figure 6:
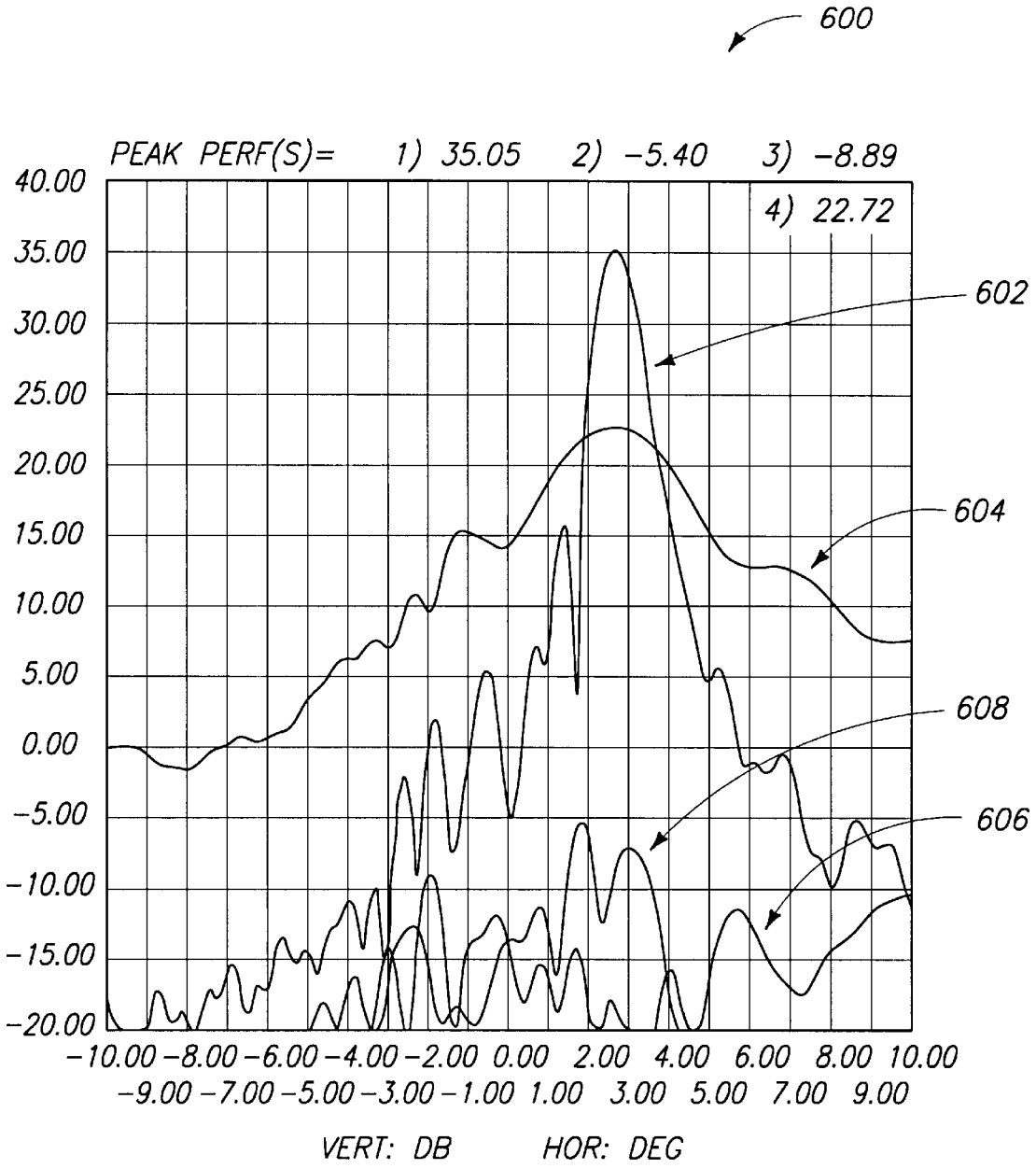
FIG. 6 illustrates the pattern cuts of the two beams reconfigured to the edge of the Earth as generated by the present invention.

FIG. 6 illustrates the pattern cuts of the two beams reconfigured to the edge of the Earth as generated by the present invention.

Graph 600 shows co-polar radiation patterns 602 and 604, and cross-polar radiation patterns 606 and 608. Patterns 602 and 606 correspond to the two-degree beam 304, and patterns 604 and 608 correspond to the nine-degree beam 302. Cross-polar patterns 606 and 608 are considerably lower in power than the corresponding co-polar pattern 602 and 604 peaks, and are in the range of 30 dB below the co-polar pattern 602 and 604 peaks. Table 2 summarizes the typical performance of the antenna system 200 of the present invention when the beams are pointed towards the edge of the Earth.

Implementation

FIGS. 7 and 8A–8C illustrate exemplary methods of implementing the present invention.

Figure 7:
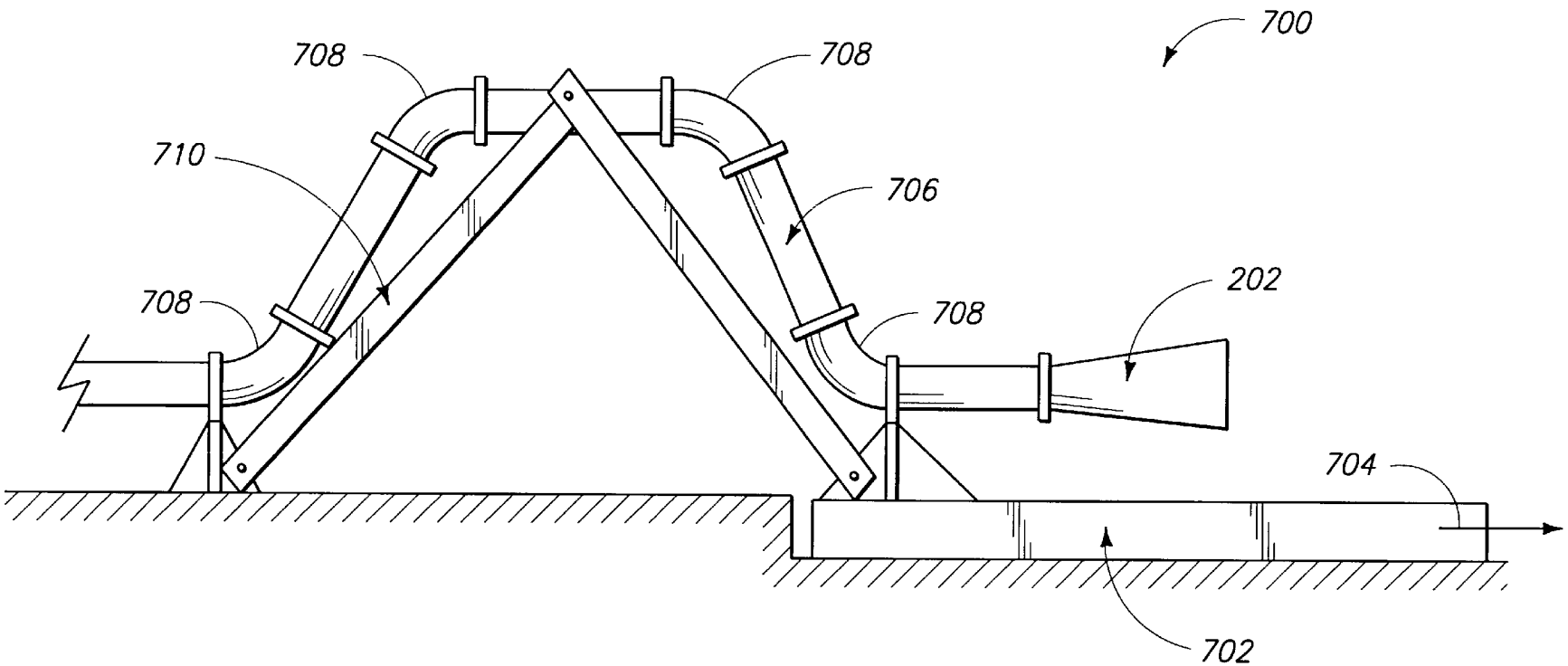
FIGS. 7 and 8A–8C illustrate exemplary methods of implementing the present invention.

FIG. 7 illustrates a method for moving the feed horn 202 while the subreflector 102 and main reflector 104 remain relatively stationary. A system 700 provides a platform 702 that allows horn 202 to be moved in a linear fashion. The axis 704 of platform 702 is aligned with the optimal axis 204. Rigid waveguide 706 and flexible waveguides 708 allow actuator 710 to move feed horn 202 in a linear fashion while still providing a low-loss input to feed horn 202. Actuator is typically connected to a motor or other such driving force that drives feed horn 202 along a rail embedded into platform 702, but other mechanical or electrical methods for moving feed horn 202 are possible. The linear actuator 710 and platform 702 provide the required linear motion to focus/defocus the feed horn 202 as required.

Figure 8A:
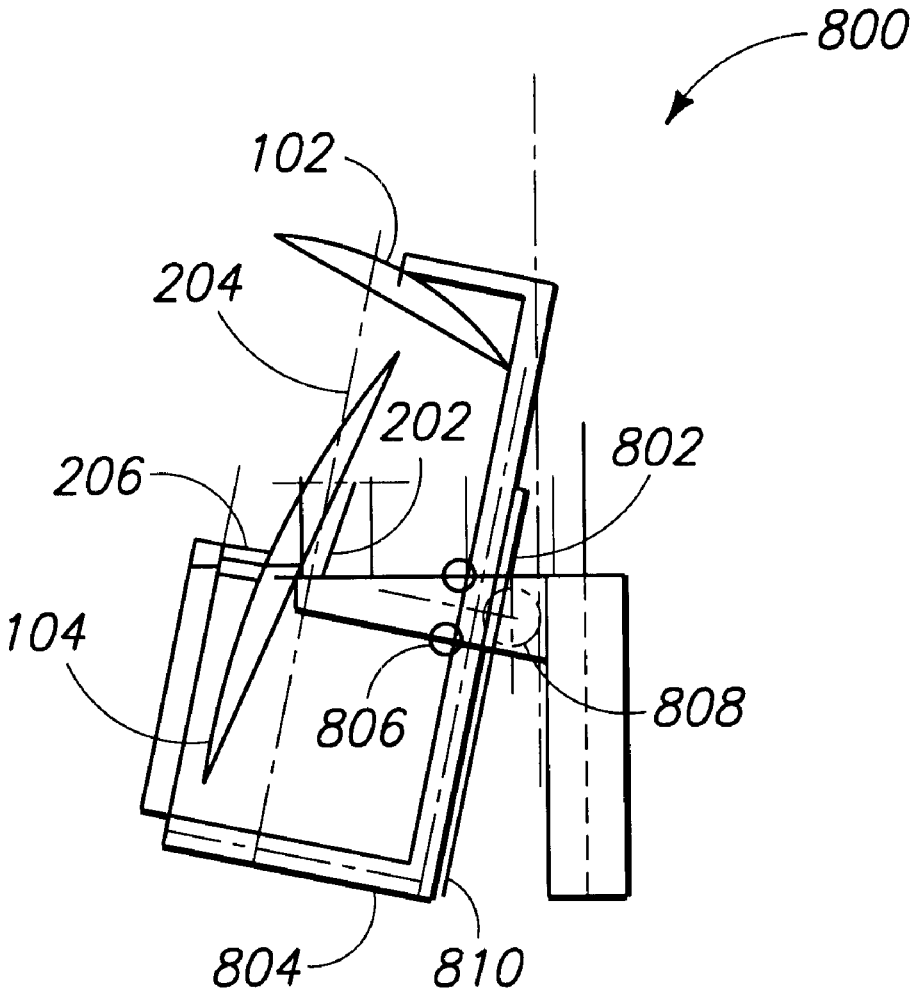
Figure 8B:
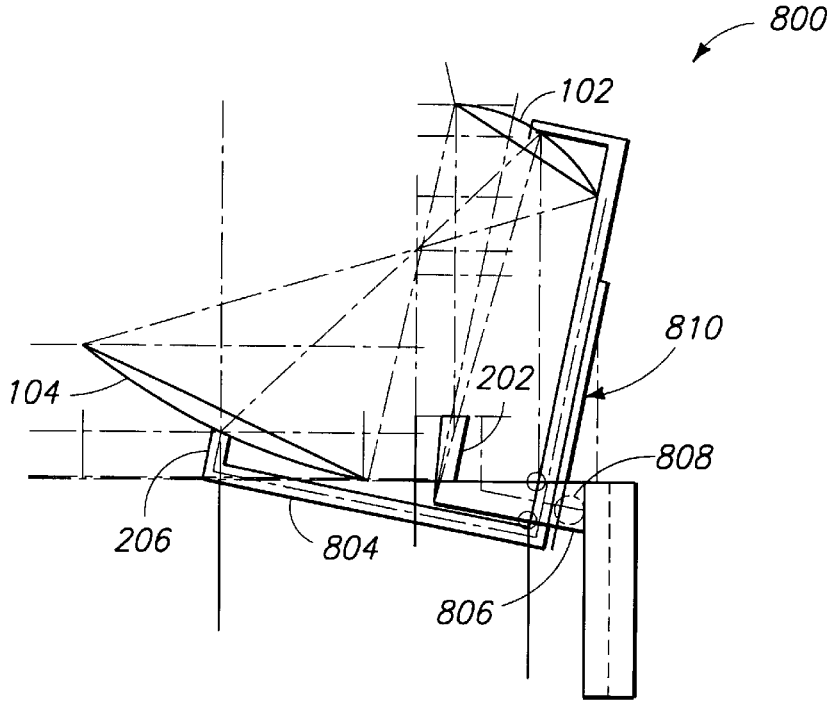
Figure 8C:
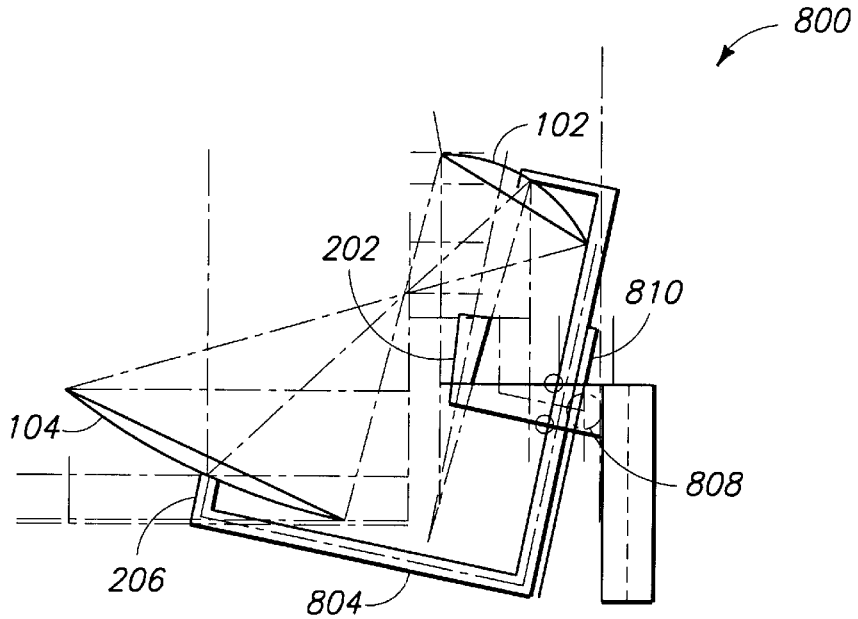

FIGS. 8A–8C illustrate a method for moving the subreflector 102 and the main reflector 104 together while leaving the feed horn 202 in a fixed position.

Another method of achieving the benefits of the present invention is to use a fixed feed horn 202 and associated electronics and the zooming features are implemented by simultaneous articulation of the subreflector 102 and the main reflector 104. This articulation is achieved by moving both reflectors together through a linear translating mechanism along the optimal axis and towards the feed by about 23 inches.

FIG. 8A illustrates system 800 in a stowed position, which is typically used during launch and prior to deployment of the satellite. Feed horn 202 is shown oriented along optimal axis 204, and subreflector 102, and main reflector 104 are moved via motor system 802 that drives structure 804. Main reflector 104 and subreflector 102 are mounted to rib structure 804, and motor system 802 provides linear guidance control through guide wheels along a straight ramp portion of structure 804. Gears 806 and drive motor 808 are shown as driving structure 804 through a linear range of motion, which can be accomplished via a linear tread 810 or other mechanical systems. Gears 806 can also be guide wheels or other mechanical systems that provide stability and linear motion to system 800. A reflector pointing mechanism 206 supports the main reflector 104 and allows +/−5.0 degrees of angular pointing range in both azimuth and elevation.

Figure 9:
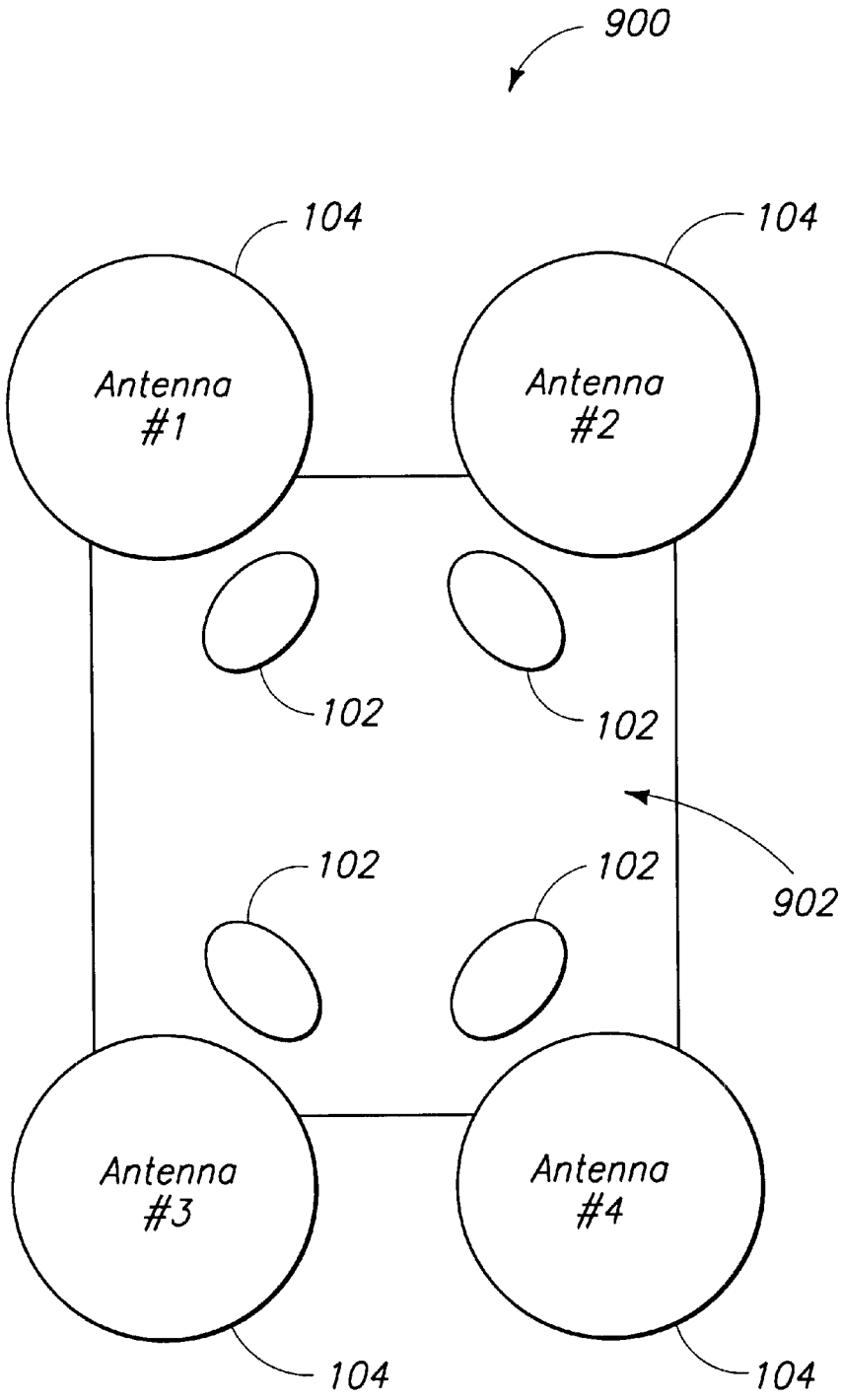
FIG. 9 illustrates a typical installation of the present invention.

FIG. 9 illustrates a typical installation of the present invention on the nadir panel of the spacecraft.

Spacecraft 900 is shown with nadir panel 902. On nadir panel 902, four main reflectors 104 with four associated subreflectors 102 are shown. Each of the four main reflectors 104 with their associated subreflectors 102 can generate a zoomable beam and all four beams can be independently reconfigurable over the global field-of-view for the spacecraft 900. All four zoomable beams shown on spacecraft 900 can be used to enhance the capacity of the satellite by forming either four spatially isolated beams that reuse the spectrum or by locating all of the beams at the same geographical location and using four transponders that carry different channels.

Process Chart

Figure 10:
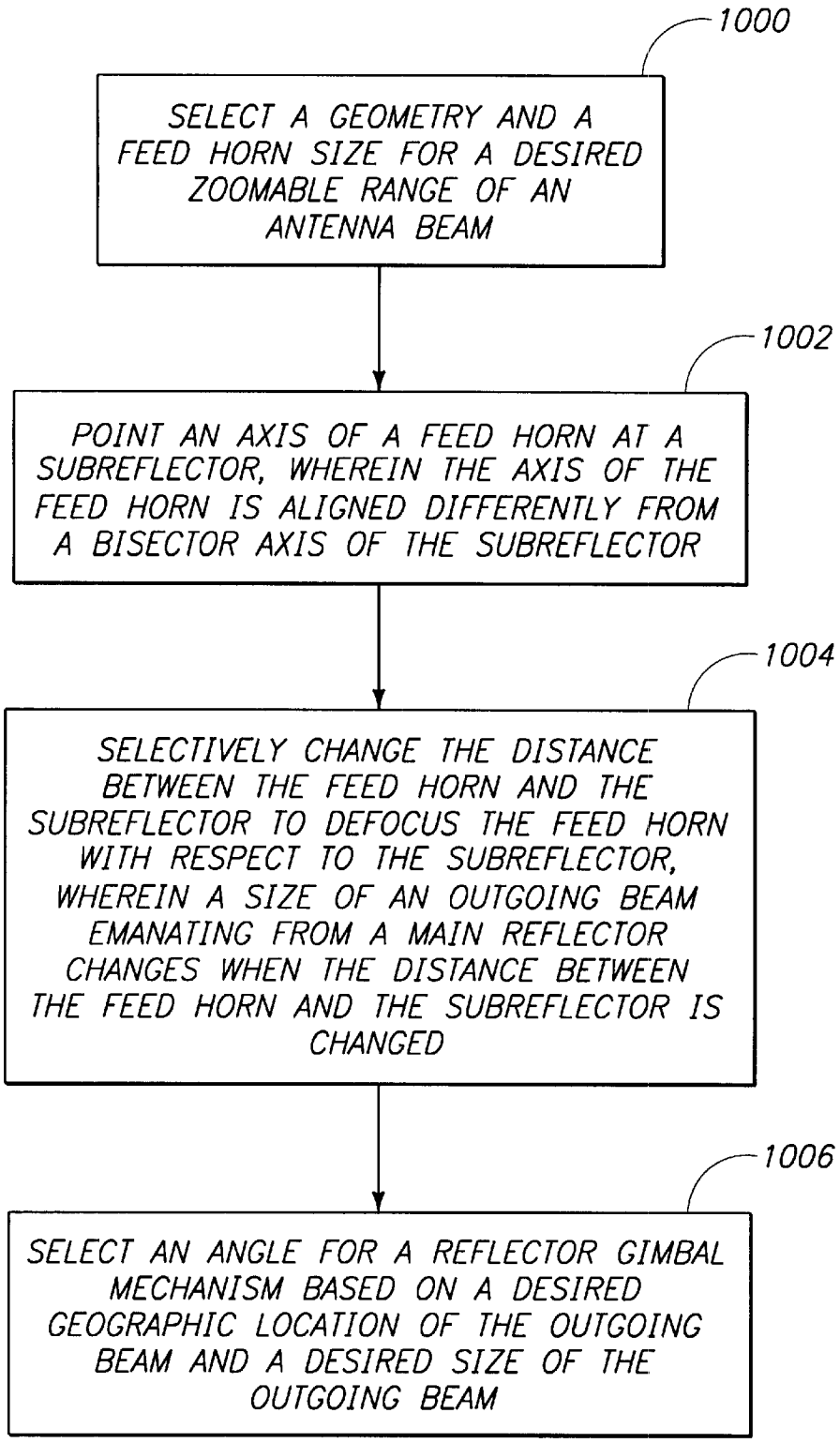
FIG. 10 is a flow chart illustrating exemplary steps used to practice the present invention.

FIG. 10 is a flow chart illustrating exemplary steps used to practice the present invention.

Block 1000 illustrates performing the step of selecting a geometry and a feed horn size for the desired zoomable range of the antenna beams.

Block 1002 illustrates performing the step of pointing an axis of a feed horn at a subreflector, wherein the axis of the feed horn is aligned differently from the bisector axis of the subreflector.

Block 1004 illustrates performing the step of selectively changing the distance between the feed horn and the subreflector to defocus the feed horn with respect to the subreflector, wherein a size of an outgoing beam emanating from a main reflector changes when the distance between the feed horn and the subreflector is changed.

Block 1006 illustrates performing the step of selecting an angle for a reflector gimbal mechanism based on a desired geographic location of the outgoing beam and a desired size of the outgoing beam.

Conclusion

This concludes the description of the preferred embodiment of the invention. The following paragraphs describe some alternative methods of accomplishing the same objects. The present invention, although described with respect to satellites, can be used on ground stations with similar results. Further, the frequency band of the feed horn can utilize any radio frequency bandwidth without departing from the scope of the present invention. Also, a combination of the movement mechanisms can also be used, e.g., the feed horn can be moved over a certain distance, while the remaining movement is performed by the subreflector/main reflector, if desired or needed for a specific application.

In summary, the present invention discloses a method and system for reconfiguring an antenna system. The system comprises a feed horn, a subreflector, and a main reflector. The feed horn is pointed at an axis removed from the bisector axis of the subreflector. The distance between the feed horn and the subreflector can be changed to defocus the feed horn with respect to the subreflector, wherein a size of the outgoing beam emanating from the main reflector changes when the distance between the feed horn and the subreflector is changed.

The method comprises selecting a geometry and a feed horn size for a desired zoomable range of an outgoing antenna beam, pointing an axis of a feed horn at a subreflector, wherein the axis of the feed horn is aligned differently from the bisector axis of the subreflector, selectively changing the distance between the feed horn and the subreflector to defocus the feed horn with respect to the subreflector, wherein a size of the outgoing beam emanating from a main reflector changes when the distance between the feed horn and the subreflector is changed, and selecting an angle for a reflector gimbal mechanism based on a desired geographic location of the outgoing beam and a desired size of the outgoing beam.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A reconfigurable antenna system, wherein the antenna system produces an outgoing beam of various sizes, comprising:

a feed horn;

a subreflector, wherein the feed horn is pointed at an axis tilted from a bisector axis of the subreflector; and a main reflector;

a structure connecting the subreflector and the main reflector, the structure for changing a distance between the feed horn and the subreflector to defocus the feed horn with respect to the subreflector, wherein a size of the outgoing beam emanating from the main reflector changes when the distance between the feed horn and the subreflector is changed.

2. The system of claim 1, wherein the feed horn is moved and the subreflector and the main reflector remain stationary.

3. The system of claim 2, wherein the feed horn is moved using a linear actuator.

4. The system of claim 1, wherein the feed horn remains stationary and the subreflector and the main reflector are moved.

5. The system of claim 4, wherein the subreflector and the main reflector are moved using a linear actuator.

6. The system of claim 1, further comprising a mechanism, coupled to the main reflector, for moving the main reflector with respect to the subreflector and the feed horn.

7. The system of claim 6, wherein the mechanism moves the main reflector in azimuth and elevation directions with respect to the subreflector and the feed horn.

8. The system of claim 6, wherein the mechanism moves the main reflector to maintain a center of the outgoing beam substantially stationary when the distance between the feed horn and the subreflector is changed.

9. The system of claim 6, wherein the outgoing beam is pointed in a different direction using the mechanism to cover a different geographic area.

10. The system of claim 1, further comprising:

a second feed horn;

a second subreflector, wherein the second feed horn is pointed at an axis removed from a bisector axis of the second subreflector; and a second main reflector, wherein a distance between the second feed horn and the second subreflector is changed to defocus the second feed horn with respect to the second subreflector, wherein a size of a second outgoing beam changes when the distance between the second feed horn and the subreflector is changed, and wherein the second outgoing beam is controlled independently of the outgoing beam.

11. The system of claim 1, wherein the outgoing beam is changed to increase the coverage area of the outgoing beam.

12. The system of claim 1, wherein the outgoing beam is changed to decrease the coverage area of the outgoing beam.

13. The system of claim 1, wherein the feed horn is located at a focal point of the subreflector.

14. The system of claim 1, wherein the feed horn is located away from a focal point of the subreflector and displaced in a transverse plane.

15. A method for communicating using a satellite, comprising:

selecting a geometry and a feed horn size for a desired zoomable range of an outgoing antenna beam;

pointing an axis of a feed horn at a subreflector, wherein the axis of the feed horn is tilted from the bisector axis of the subreflector;

selectively changing the distance between the feed horn and the subreflector to defocus the feed horn with respect to the subreflector, wherein a size of the outgoing beam emanating from a main reflector changes when the distance between the feed horn and the subreflector is changed; and selecting an angle for a reflector gimbal mechanism based on a desired geographic location of the outgoing beam and a desired size of the outgoing beam.

16. Tithe method of claim 15, wherein the distance between the feed horn and the subreflector is changed by moving the feed horn.

17. The method of claim 15, wherein the distance between the feed horn and the subreflector is changed by moving the subreflector and the main reflector substantially simultaneously.

18. The method of claim 15, further comprising moving the main reflector with respect to the subreflector and the feed horn.

19. The method of claim 18, wherein the main reflector moves in azimuth and elevation directions with respect to the subreflector and the feed horn.

20. A reconfigurable antenna system, wherein the antenna system produces an outgoing beam of various sizes, comprising:

a feed horn;

a subreflector, wherein the feed horn is pointed at an axis tilted from a bisector axis of the subreflector; and a gimbaled main reflector;

a structure connecting the subreflector and the main reflector, the structure selectably changing a distance between the feed horn and the subreflector to defocus the feed horn with respect to the subreflector, wherein a size of the outgoing beam emanating from the main reflector changes when the distance between the feed horn and the subreflector is changed.

21. The reconfigurable antenna system of claim 20, wherein the size of the outgoing beam emanating from the main reflector changes according to an aspect ratio of at least 1:1.5 when the distance between the feed horn and the subreflector is changed.

* * * * *